US005876267A

United States Patent [19]

Kanda

[11] Patent Number: 5,876,267

[45] Date of Patent: Mar. 2, 1999

[54] BLASTING METHOD AND APPARATUS

[75] Inventor: Shinji Kanda, Nagoya, Japan

[73] Assignee: Fuji Manufacturing Co., Ltd., Tokyo, Japan

[21] Appl. No.: 911,723

[22] Filed: Aug. 15, 1997

[30] Foreign Application Priority Data

Aug. 19, 1996 [JP] Japan ..... 8-217474

[51] Int. Cl.[6] ..... B24C 5/04

[52] U.S. Cl. ..... 451/38; 451/102

[58] Field of Search ..... 451/102, 90, 78, 451/38, 39, 75

[56] References Cited

U.S. PATENT DOCUMENTS 5,265,383 11/1993 Shank, Jr. ..... 451/90
5,283,990 2/1994 Shank, Jr. ..... 451/90

FOREIGN PATENT DOCUMENTS 838671 12/1938 France ..... 451/102
61-241067 10/1986 Japan .
3-149184 6/1991 Japan .
7-79163 3/1995 Japan .
221534 7/1968 U.S.S.R. ..... 451/102

*Primary Examiner*—Robert A. Rose
*Attorney, Agent, or Firm*—Millen, White, Zelano, & Branigan, P.C.

[57] ABSTRACT

A blasting apparatus and a blasting method enable a processing pattern to be enlarged or modified in a suction type blasting apparatus by using a relatively simple composition, and also permit stable, continuous ejection of an abrasive in the enlarged or modified processing pattern. A nozzle (42) of a blast gun (40) of a suction type blasting apparatus is surrounded by a nozzle cover (49) with a predetermined gap provided therebetween, and a passage (43) which is opened in an abrasive ejecting direction between the outer periphery of the nozzle (42) and the inner periphery of the nozzle cover (49) is communicated with a supply source of compressed air. An abrasive dispersion chamber (52) serving as a dispersing nozzle is connected to an ejection port (47) of the blast gun (40).

13 Claims, 7 Drawing Sheets

BLASTING METHOD AND APPARATUS

BACKGROUND OF THE INVENTION

1. Field of the Invention

The present invention relates to a blasting apparatus used for ejecting at high speed an abrasive or grinding material composed of natural silica sand, alumina or silicon carbide powder, glass beads, fine steel balls, etc. with a fluid such as air in order to form a satin finish pattern or other pattern on a workpiece, or to perform precision engraving of glass, silicon wafers, etc., engraving of the ribs of plasma displays, coating engraving, the surface treatment such as coating pretreatment, or blasting for surface processing and, more particularly, to a blasting method and a blasting apparatus which make it possible to enlarge or modify a processing shape (herein after referred to as "processing pattern"), which is to be formed on the surface of a workpiece, by ejecting an abrasive and also to ensure uniform blast density of the abrasive in the processing pattern.

2. Description of Prior Art

Hitherto, as a suction type blast gun for this type of blasting apparatus, a blast gun 10 shown in FIG. 9, for example,has been used. The blast gun 10 is equipped with a gun main body 11 which has an abrasive intake chamber 12 into which an abrasive is introduced through an abrasive introducing inlet 24 via an abrasive hose 31 from a recovery tank of a blasting apparatus. The abrasive intake chamber 12 has a conical inner surface 16 at the front end thereof, a nozzle 14 being provided at the conical inner surface 16.

The distal end of a jet 13 having the rear end thereof in communication with a supply source of compressed air, not shown, is inserted in the conical inner surface 16 from the rear of the abrasive intake chamber 12 so that compressed air having a relatively high pressure supplied from the supply source of compressed air, may be injected through the injection outlet at the distal end of the jet 13.

A cylindrical holder 15 has a tapered inner peripheral surface. The tapered portion of the outer peripheral nozzle 14 is fitted to the tapered portion of the inner periphery of the holder 15 and the threaded portion formed on the outer periphery of the holder 15 is screwed, for example, to the gun main body 11 so as to secure the nozzle 14 to the gun main body 11.

In the blast gun 10 constructed as described above, when high pressure air is injected through the distal end of the jet 13, which is in communication with the supply source of compressed air, via the hose 32, negative pressure is produced in the abrasive intake chamber 12. The negative pressure causes the abrasive in the recovery tank, not shown, to be sucked into the abrasive intake chamber 12 via the abrasive hose 31.

The abrasive in the abrasive intake chamber 12 is drawn into an annular gap between the conical inner surface 16 and the outer periphery of the jet 13, then it rides on an air stream injected from the jet 13 so that it is sprayed while conically dispersing outside the nozzle 14 to form an approximately circular processing pattern on the surface of a workpiece.

In such a conventional suction type blast gun 10, the inside diameter of the ejection hole of the jet 13 is made small in order to permit high speed air stream released from the jet 13; therefore, the effective injection range wherein uniform processing by an abrasive ejected with an air stream, which is emitted from the jet 13 and which has a small sectional area, can be achieved is determined by the inside diameter of the ejection hole of the nozzle 14, and the processing pattern is accordingly limited.

Hence, in order to carry out blasting on a workpiece to a desired pattern, it is required to move the blast gun 10 and/or the workpiece or to take other similar measures to continue the intended pattern formed by the blast gun.

In the processing method described above, however, if a blast gun for a relatively small processing pattern is used, then the blast gun and/or the workpiece must be moved over a large area This requires relative long time to finish one processing cycle and also requires that the blast gun or the workpiece be moved accurately at a constant speed and at constant intervals in order to perform uniform processing on the workpiece, thus making the blasting difficult. For this reason, there has been a demand for developing of a blast gun which permits a larger processing pattern and also a uniform blast density of an abrasive in the processing pattern.

The suction type blast gun, however, cannot meet the demand for a larger processing pattern by using such a simply method in which the inside diameter of the ejection hole, i.e. the nozzle diameter, of the nozzle 14 of the blast gun 10 is increased.

If the inside diameter of the jet 13 is made larger to provide a larger processing pattern, then the injection speed and the injection pressure of the air stream emitted from the jet will decrease; therefore, in order to maintain the injection speed and the injection pressure at constant levels, it would be necessary to employ a larger compressor or the like with a larger capacity as the supply source of compressed air, inevitably making the apparatus larger and more expensive. If the inside diameter of the nozzle or the jet is increased to provide larger processing patterns, then the abrasive blast density in a processing pattern would be uneven, resulting in uneven blasting effects.

In view of the shortcomings of the prior art described above, the applicant has already applied the invention on a method and apparatus for increasing the width of a processing pattern by ejecting two air streams toward nearly the same positions with respect to the center of an injection stream of a mixed fluid composed of an abrasive and compressed air emitted from a blast gun in such a manner that they hold the jet stream of the mixed fluid therebetween (Japanese Patent Application No. 7-79163 applied on Apr. 4, 1995 not laid open before the convention date on which the present application is based).

According to the method and apparatus disclosed under Japanese Patent Application No. 7-79163, the processing pattern can be made significantly wider than that of a conventional blast gun and a uniform blast density of an abrasive in the processing pattern can be achieved.

The processing patterns produced by the aforesaid method is limited to circular or elliptic patterns, and it is difficult to change the processing patterns according to the material of the workpiece, the processing conditions, processing shape, etc., thus limiting the enlargement of the processing patterns.

In addition to the suction type blasting apparatus, there is a straight-hydraulic type blasting apparatus. In this straight-hydraulic type blasting apparatus, fine particles are sealed in an abrasive tank, compressed air is supplied into the tank, and the fine particles ejected through an outlet connected to the bottom of the tank are ejected with the compressed air through the nozzle; therefore, this type of blasting apparatus does not have the member corresponding to the jet of the suction type blasting apparatus, making it possible to easily enlarge the processing patterns by increasing the inside diameter of the nozzle. The straight-hydraulic blasting apparatus, however, has shortcomings such as the need for stopping the blasting apparatus to supply the abrasive when the tank has run out of the abrasive, making it unsuitable for continuous processing based on continuous blast of an abrasive. In addition, the amount of injected abrasive varies, depending on the amount of the abrasive present in the abrasive tank, leading to such problems as variations in the processing accuracy as time elapses when an abrasive is ejected continuously for a predetermined time. Thus, the straight-hydraulic blasting apparatus is unsuitable especially for forming ribs or barriers of plasma displays or precision machining and micro-machining of sapphire, glass, silicon wafer, ceramics, or other materials used for semiconductors and other electronic equipment parts.

SUMMARY OF THE INVENTION

Accordingly, an object of the present invention is to provide a blasting method and a blasting apparatus which permit a processing pattern to be made wider and also permit the processing pattern shape to be changed as necessary in a suction type blasting apparatus which is able to continuously eject a stable amount of an abrasive, and also to provide a blasting method and an apparatus which allow highly accurate blasting with a uniform blasting density of an abrasive in an enlarged processing pattern.

To this end, according to one aspect of the present invention, there is provided a blasting method in which a nozzle 42 is disposed in the front of a jet 13 in communication with a supply source of compressed air in an air ejecting direction, an abrasive in an abrasive intake chamber 12 in communication with an abrasive supply source disposed between the jet 13 and the nozzle 42 is sucked in by an air stream emitted from the jet 13, and a mixed fluid of the abrasive and the compressed air is ejected through the nozzle 42 to the surface of a workpiece W;

wherein secondary compressed air, which has been supplied from the supply source of compressed air, is introduced at the front of the nozzle 42 in a mixed fluid ejecting direction and merged with the ejected stream of the mixed fluid, and an ejected stream of a secondary mixed fluid which has been merged with the secondary compressed air is injected in an abrasive dispersion space formed to have an arbitrary cross-sectional shape at the front in the secondary mixed fluid ejecting direction, and an ejected stream of the secondary mixed fluid, which has been introduced in the abrasive dispersion space, is rectified to the cross-sectional shape of the abrasive dispersion space and ejected to the surface of the workpiece.

Further according to another aspect of the present invention, there is provided a blasting apparatus equipped with: a blast gun which draws in and ejects an abrasive supplied from an abrasive supply source by an air stream supplied from a supply source of compressed air; wherein the blast gun 40 is provided with a nozzle 42 in the air ejecting direction of a jet 13 in communication with the supply source of compressed air, an abrasive intake chamber 12 in communication with the abrasive supply source, between the jet 13 and the nozzle 42, and a nozzle cover 49 surrounding the nozzle 42 with a predetermined gap therebetween,and a passage 43 of compressed air in communication with the supply source of compressed air between the outer surface of the nozzle 42 and the inner surface of the nozzle cover 49, the passage 43 being opened in the ejecting direction of the nozzle 42 so as to merge the passage 43 at the front in the direction in which the mixed fluid is injected by the nozzle 42.

According to yet another aspect of the present invention, there is provided a blasting apparatus having a nozzle 42 at the front of the air ejecting direction of a jet 13 in communication with a supply source of compressed air, and a suction type blast gun 40 equipped with an abrasive intake chamber 12 in communication with an abrasive supply source, between the jet 13 and the nozzle 42; wherein the nozzle 42 of the blast gun 40 is projected in a merging chamber 48 in communication with the supply source of compressed air at the front in the ejecting direction of the nozzle, and the merging chamber 48 is communicated with an abrasive dispersion chamber 52 which is provided with an abrasive dispersion space having a section formed to an arbitrary shape, which introduces a blast stream of a secondary mixed fluid emitted from the merging chamber 48, and which rectifies the blast stream to the cross-sectional shape of the abrasive dispersion space and ejects it.

BRIEF DESCRIPTION OF THE DRAWINGS

The object and advantages of the invention will become understood from the following detailed description of preferred embodiments thereof in connection with the accompanying drawings in which like numerals designate like elements, and in which.

DETAILED DESCRIPTION OF THE PREFERRED EMBODIMENTS

An embodiment of the entire configuration of a blasting apparatus in accordance with the present invention will now be described.

Figure 6:
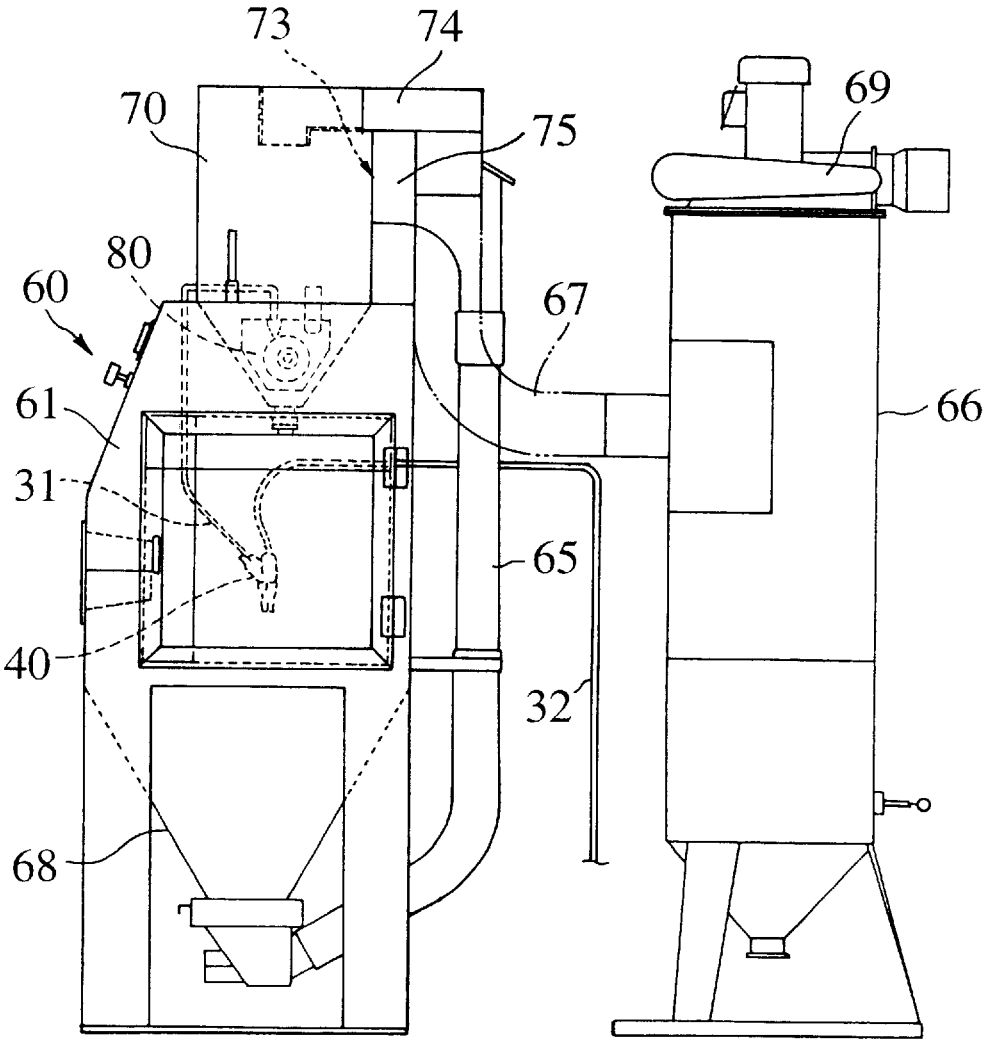
FIG. 6 is a general schematic view of a blasting apparatus according to the present invention.
Figure 7:
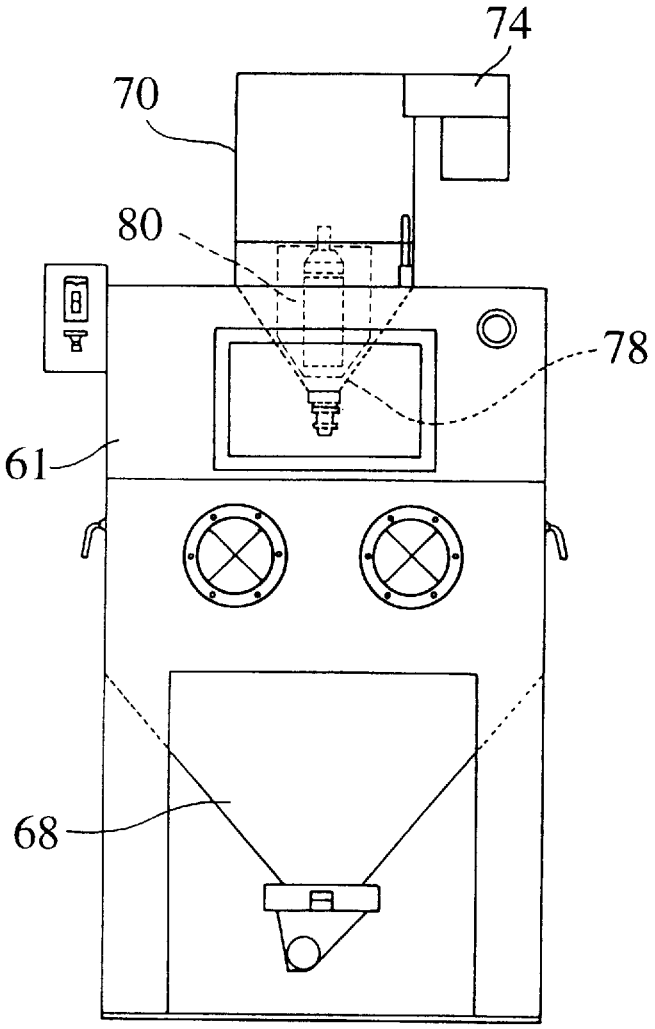
FIG. 7 is a general schematic view of the blasting apparatus according to the present invention.

The blasting apparatus used in the embodiment is a pneumatic suction type blasting apparatus as shown in FIG. 6 and FIG. 7. In FIG. 6 and FIG. 7, a cabinet 61 is equipped with a supplying port through which a workpiece W is loaded or unloaded; provided in the cabinet 61 is a blast gun 40 which is connected to an abrasive dispersion chamber 52 and which ejects an abrasive to the workpiece W fed through the supplying port.

A hopper 68 is provided at the bottom of the cabinet 61; the bottom end of the hopper 68 is communicated to the top of a recovery tank 70 for collecting an abrasive which is installed on the top of the cabinet 61 via a conduit 65.

The recovery tank 70 is a so-called cyclon collector for separating dust from an abrasive; it is constituted, as shown in FIG. 6, by a cylindrical section at the top and a conical section at the bottom which is gradually tapered toward the bottom. An inlet 73 is formed on the top side wall of the cylindrical section of the recovery tank 70; an end of the conduit 65 is connected to the inlet 73 via a communicating tube 75.

The axis of the communicating tube 75 is positioned in the tangent direction of the inner wall surface of the cylindrical section having a circular cross section; therefore, an air stream introduced into the recovery tank 70 through the communicating tube 75 moves down while turning along the inner wall of the cylindrical section.

At the bottom end of the conical section of the recovery tank 70, there is an abrasive supply device 80 for regulating the amount of the abrasive ejected from the abrasive dispersion chamber 52; the blast gun 40, to which the abrasive dispersion chamber 52 is connected, is communicated with the abrasive supply device 80.

Figure 8:
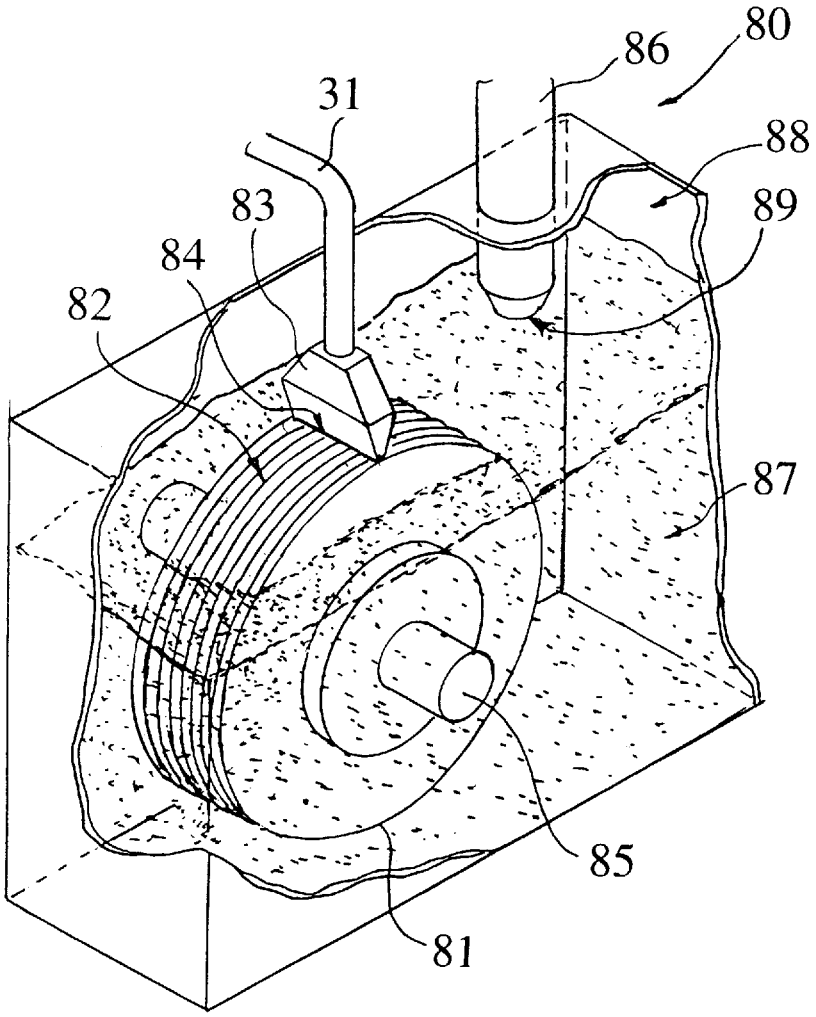
FIG. 8 is a perspective view illustrative of the interior of an abrasive supply device according to the present invention.

In FIG. 8, an introducing pipe 86 communicating with the bottom of the recovery tank 70 is inserted into the abrasive supply device 80 from the top wall surface thereof; the surface of an inlet 89 at the distal end of the introducing pipe 86 is positioned at a height about two thirds of the height from the bottom surface of the abrasive supply device 80. Thus, an abrasive in the recovery tank 70 drops into the abrasive supply device 80 located below via the introducing pipe 86 to form an abrasive layer below the inlet 89, the abrasive layer being composed of the abrasive building up on the bottom inside the abrasive supply device 80. An air layer 88 is formed on the abrasive layer. As the abrasive flows from the recovery tank 70 into the abrasive supply device 80, the top surface of the abrasive layer goes up until it reaches the height of the inlet 89 of the introducing pipe 86. This means that when the top surface of the abrasive layer rises to the inlet 89, the abrasive in the recovery tank 70 no longer moves into the abrasive supply device 80. Hence, approximately one third of the upper portion of the abrasive supply device 80 is always filled with the air layer 88, whereas approximately two thirds of the lower portion thereof are always filled with the abrasive layer.

A gathering rotary board 81 has a groove section 82 composed of a plurality of endless, continuous V-shaped grooves arranged in parallel widthwise on the circumferential surface of the gathering rotary board 81 in the circumferential direction. The gathering rotary board 81 is longitudinally rotatably supported by a rotary shaft 85 via a bearing in the abrasive layer in the abrasive supply device 80. The rotary shaft 85 is positioned below the top surface of the abrasive layer, whereas a part of the upper or lower portion of the gathering rotary board 81 is positioned such that it is exposed to the air layer 88; the upper portion of the gathering rotary board 81 refers to the area located above the horizontal line passing through the center of the rotary shaft of the gathering rotary board 81. Thus, in this embodiment, the full circumferential lower half of the gathering rotary board 81 is securely sunk in the abrasive layer, while a part of the circumferential upper half of the gathering rotary board 81 is exposed to the air layer 88. Hence, when the gathering rotary board 81 rotates, the abrasive easily moves into the groove section 82 and the abrasive of the abrasive layer is securely transferred to the air layer 88 since the circumferential upper half of the gathering rotary board 81 is partly buried in the abrasive layer.

The rotary shaft 85 is supported by the bearing, not shown, outside the abrasive supply device 80; it is connected to a rotary driving means such as a motor via a V belt attached to a pulley provided on an end of the rotary shaft 85 to transmit torque. The rotational speed of the rotary driving means can be easily adjusted by a known means.

An intake pipe 83 is connected to the trailing end of the abrasive hose 31 in communication with the abrasive dispersion chamber 52 in the abrasive supply direction; the trailing end of the intake pipe 83 has an inlet 84 which has approximately the same width as the circumferential surface of the gathering rotary board 81, and it is tapered from the inlet 84 toward the front in the abrasive supply direction. As shown in FIG. 8, the inlet 84 is shaped like a funnel and the full lengthwise dimension of the inlet 84 is set so that it can fully cover the width of the gathering rotary board 81, the inlet 84 being located nearly at the top of the circumferential surface of the gathering rotary board 81.

As the gathering rotary board 81 is turned clockwise in FIG. 8 at an equal velocity by the rotary driving means, the abrasive from the abrasive layer which has entered in the groove section 82 on the circumferential surface of the gathering rotary board 81 is transferred to the air layer 88. When compressed air is supplied from the supply source of compressed air to the nozzle, negative pressure is produced in the abrasive hose 31 and the intake pipe 83, and the abrasive in the groove section 82 of the turning gathering rotary board 81 is sucked in through the inlet 84 at the circumferential top of the gathering rotary board 81, thus being supplied to the nozzle via the abrasive hose 31. The gathering rotary board 81 is turned at the equal velocity and the amount of the abrasive picked up by the circumferential surface of the gathering rotary board 81 is constant, so that the amount of the abrasive drawn in through the inlet 84 and supplied to the nozzle is accordingly constant. The edge of the inlet 84 functions as a scraper for removing excess abrasive from the circumferential surface of the gathering rotary board 81, contributing to ensure the constant amount of abrasive supplied.

The rotational speed of the gathering rotary board 81 may be adjusted to increase or decrease the amount of the abrasive supplied to the nozzle. For example, the rotational speed of the gathering rotary board 81 is increased to increase the amount of an abrasive to be supplied, while the rotational speed of the gathering rotary board 81 is decreased to decrease the amount of the abrasive to be supplied. Regardless of the set rotational speed, the gathering rotary board 81 is always maintained at a constant speed so as to stably supply a fixed amount of an abrasive to the nozzle which ejects the fixed amount of the abrasive to the workpiece at all times. Thus, the rotational speed of the gathering rotary board 81 and the amount of an abrasive supplied are correlated with each other; therefore, the amount of an abrasive supplied can be easily adjusted to a desired value by determining the above relational expression and by digitizing the amount of an abrasive supplied according to the rotational speed of the gathering rotary board 81.

A communicating pipe 74 is provided nearly at the center of the top end wall surface of the recovery tank 70; it is communicated with a dust collector 66 via a discharge pipe 67.

The dust collector 66 actuates an exhauster 69 to release the air in the dust collector 66 to open air. The exhauster 69 draws out air from the cabinet 61, the conduit 65, and the recovery tank 70 to produce negative pressure in these components. The air supplied from the supply source of compressed air, not shown, is emitted with the abrasive from the abrasive dispersion chamber 52 via the blast gun 40, and the air stream runs from the cabinet 61 to the conduit 65, the recovery tank 70, and the dust collector 66.

According to the blasting method of the present invention, the blast stream of secondary compressed air is merged with the blast stream of a primary mixed fluid generated from an abrasive and primary compressed air in order to generate a blast stream of a pressurized secondary mixed fluid.

Figure 3A:
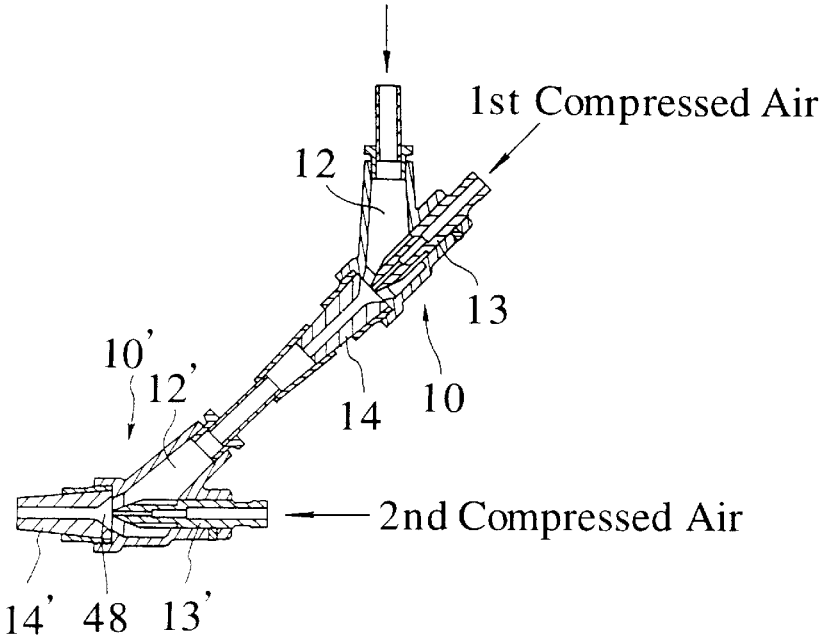
FIG. 3(A), (B) are longitudinally sectional views that provide a schematic representation of the embodiments of the present invention.
Figure 3B:
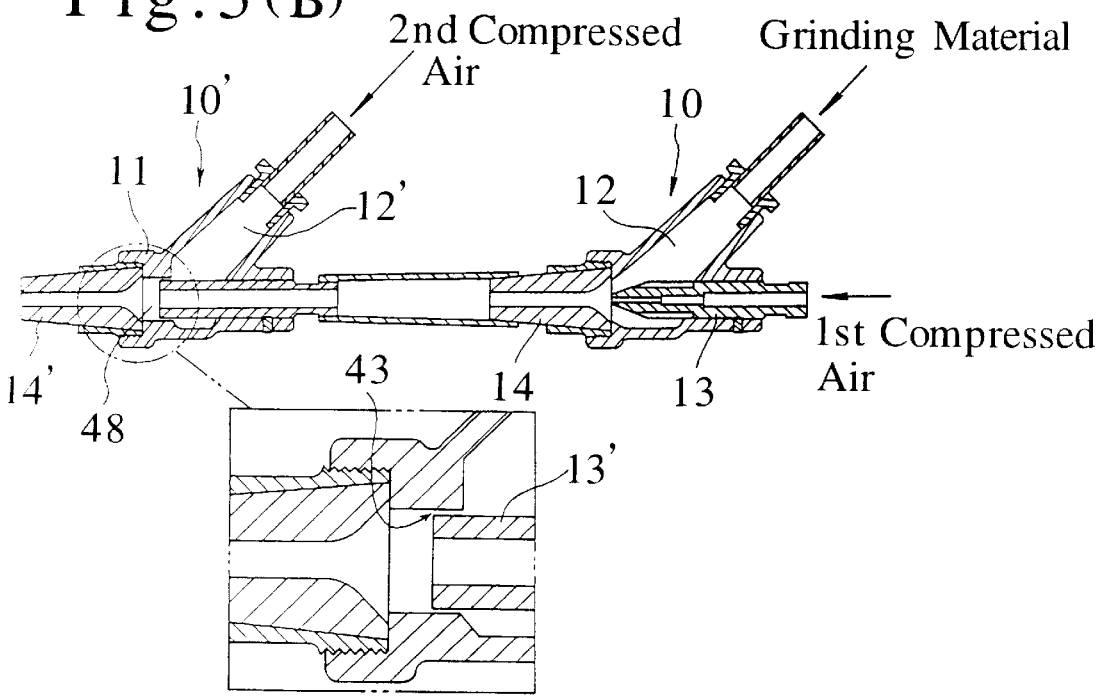
Figure 9:
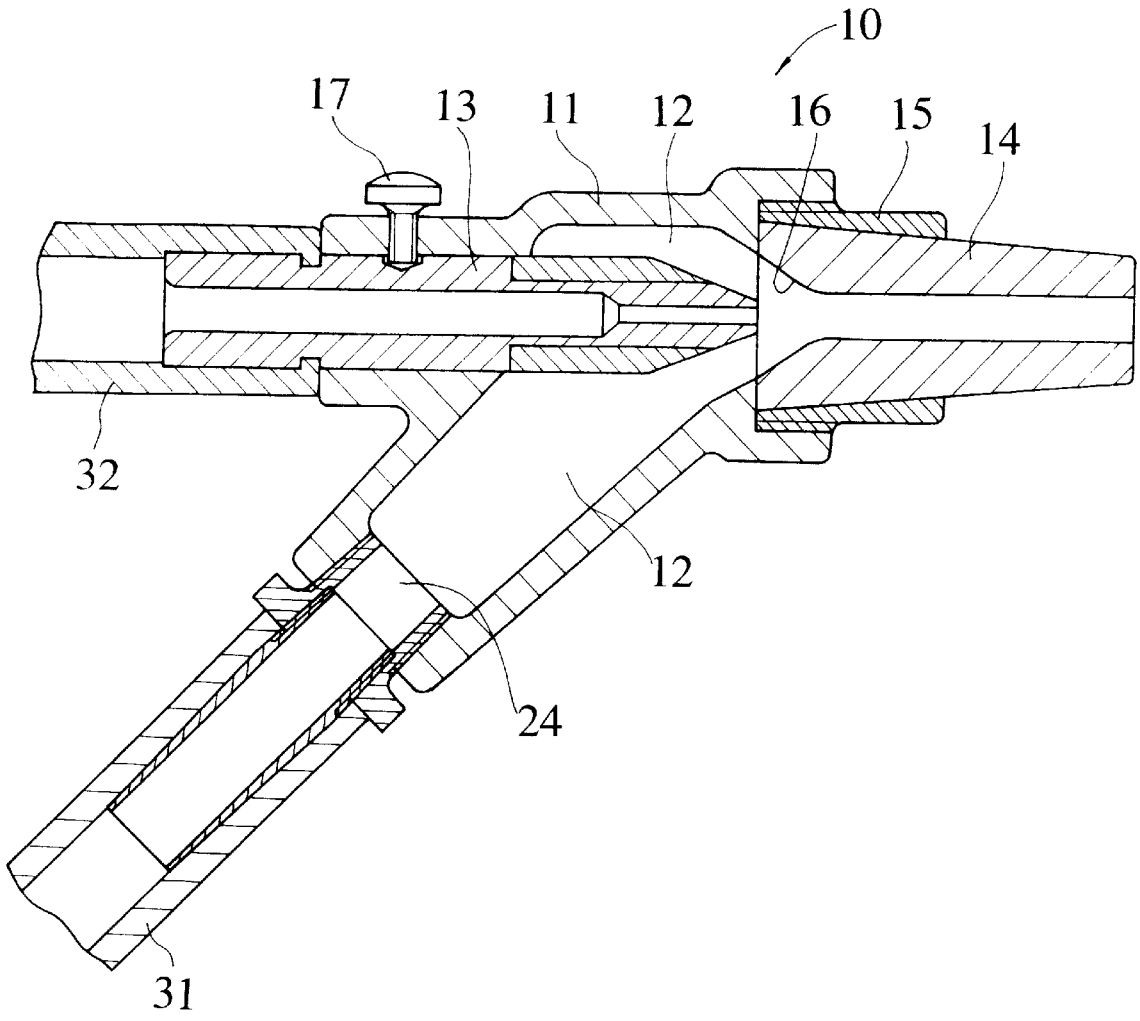
FIG. 9 is a sectional view illustrative of a known blast gun.

As an example, a blast gun 10 shown in FIG. 9 and a blast gun which has a different shape of a jet 13' shown in FIG. 3B from an already-known one as it will be discussed later are prepared. Using these blast guns 10, 10', the primary mixed fluid generated from the primary compressed air is introduced from the blast gun 10 disposed at the rear of the blast gun 10' into an abrasive intake chamber 12' or the jet 13' of the blast gun 10' positioned at the front in the direction in which the abrasive as the primary mixed fluid is emitted as shown in FIG. 3A and FIG. 3B. The secondary compressed air is introduced into the jet 13' shown in FIG. 3A or the abrasive (referred as grinding material in FIG. 3) intake chamber 12' shown in FIG. 3B so as to form a merging chamber 48 between the front of the jet 13' and the nozzle 14' (FIG. 3A) and at the rear of the nozzle 14' (FIG. 3B) via a gap 43 at the inner wall of the nozzle main body 11 in front of the jet 13'. This relatively easy method makes it possible to merge the secondary compressed air with the blast of the primary mixed fluid emitted by the primary compressed air from the already-known blast gun 10, or the blast stream of the primary mixed fluid generated from the primary compressed air emitted from the already-known blast gun is merged with the blast stream of the secondary compressed air (also referred as 1st and 2nd Compressed air in FIG. 3, respectively) so as to generate the blast stream of the pressurized secondary mixed fluid. The entire apparatus can be made smaller by employing a blast gun 40. In FIG. 3B which omits details, there is a gap between the outer periphery of the distal end of the jet-like member 13' and the inner wall of the gun main body 11, thus forming a passage 43 for the secondary compressed air.

Figure 1:
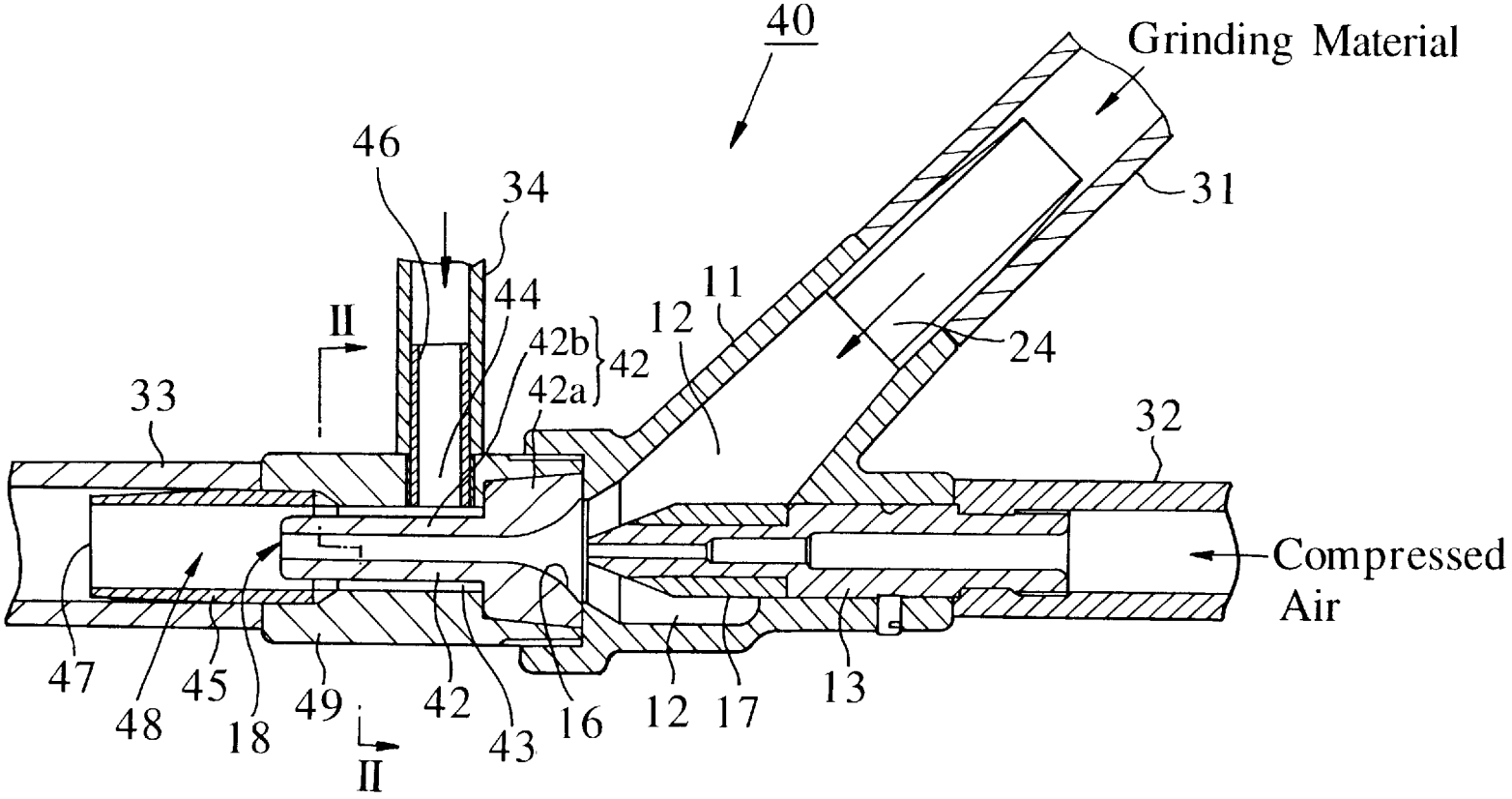
FIG. 1 is a longitudinal sectional view of a blast gun used in the present invention.
Figure 2:
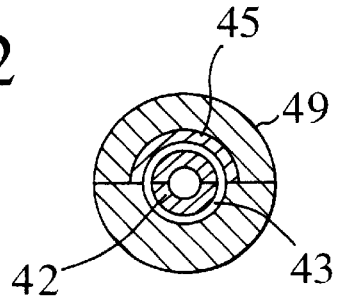
FIG. 2 is a fragmentary sectional view at the line II—II of FIG. 1.

In FIG. 1, the blast gun 40 is equipped with the gun main body 11. Formed in the gun main body 11 is the approximately cylindrical abrasive intake chamber 12 in communication with the abrasive introducing inlet 24 and through which an abrasive is drawn in from the recovery tank of the blasting apparatus via the abrasive hose 31. The front end of the abrasive intake chamber 12 has a conical inner surface 46.

Further, the distal end of the jet 13 inserted from thereof the abrasive intake chamber 12 is disposed in the abrasive intake chamber 12. The ejecting orifice of the jet 13 is disposed on the extension of the center line of the nozzle 14 inserted from the distal end of the gun main body 11 of the blast gun 40.

The jet 13 is communicated with a supply source of compressed air, not shown, via the hose 32. The blast gun of this embodiment is almost identical to the conventional blast gun 10 in that compressed air of a relatively high pressure is fed to the jet 13 via the hose 32.

In the blast gun 40 according to the present invention, as shown in FIG. 1, a nozzle 42 of the blast gun 40 is surrounded by a cylindrical nozzle cover 49 corresponding to the holder 15 or the gun main body 11 via a predetermined gap, and a passage 43 for passing the compressed air as the secondary compressed air for forcibly feeding an abrasive is formed between the of the nozzle 42 and the inner peripheral surface of the nozzle cover 49.

To be more specific, the nozzle 42 of the blast gun 40 according to the embodiment is equipped with a conical tapered surface on the outer periphery thereof, a base 42*a* inserted in the gun main body 11, and a cylindrical section 42*b* which is formed to have a cylindrical shape narrower than the base 42*a*. The nozzle 42 is fitted in the nozzle cover 49 having an inside diameter which is slightly larger than the outside diameter of the cylindrical section 42*b* of the nozzle 42 and also having an orifice which fits to the configuration of the base 42*a* of the nozzle at the rear end thereof. The rear end of the nozzle cover 49 is screwed or the like onto the gun main body 11 to secure the nozzle 42 and the nozzle cover 49 to the gun main body 11.

Then, the passage 43 through which the secondary compressed air for forcibly feeding an abrasive passes is formed via a bore 44 which will be discussed later and which is formed on the outer periphery of the nozzle cover 49 by the gap formed between the outer periphery of the cylindrical section 42*b* of the nozzle 14 and the inner peripheral surface of the nozzle cover 49.

A hose 34 through which the secondary compressed air for forcibly feeding an abrasive mentioned above is introduced is connected via a connecting fixture 46 to the bore 44 formed around the outer peripheral surface of the nozzle cover 49; the other end of the hose 34 is in communication with the supply source of compressed air which is not shown.

The outer periphery of one end of an approximately cylindrical merging nozzle 45 is secured by screwing or the like to the inner periphery of the tip of the nozzle cover 49. The cylindrical merging nozzle 45 jets out in the ejecting direction beyond the distal end of the nozzle 42, a merging chamber 48 wherein the blast of the primary mixed fluid merges with the secondary compressed air for forcibly feeding an abrasive is formed in the merging nozzle 45.

When compressed air of a relatively high pressure is supplied via the hose 32 connected to the rear end of the jet 13 of the blast gun 40 constructed as described above, the primary compressed air is ejected from the distal end of the jet 13 into the abrasive intake chamber 12 formed in the gun main body 11. Then, the negative pressure generated by the compressed air emitted from the distal end of the jet 13 causes an abrasive to be drawn from an abrasive tank, not shown, into the abrasive intake chamber 12, and the abrasive which has been thus drawn in is ejected together with an air stream, which has been emitted from the jet 13, from the nozzle 42 of the blast gun 10.

At the moment the abrasive is ejected from the nozzle 42, the blast range of the abrasive is proportional to the diameter of an injection orifice 18 at the distal end of the nozzle 42. The moment the compressed air is supplied to the jet 13, the secondary compressed air for forcibly feeding the abrasive is supplied to the passage 43, which is formed between the inner periphery of the nozzle cover 49 and the outer periphery of the nozzle 42, via the bore 44 provided in the nozzle cover 49; and the secondary compressed air released toward the injection orifice 18 of the nozzle 42 surrounds and merges with the blast streams of the primary mixed fluid ejected from the nozzle 42.

The secondary compressed air for forcibly feeding the abrasive, which has been introduced through the bore 44 of the nozzle cover 49, is ejected to the blast stream of the primary mixed fluid emitted from the nozzle 42 to merge them so as to produce the secondary mixed fluid. This causes the blast stream of the secondary mixed fluid to have a high pressure and disperse. Hence, the processing pattern formed by the blast stream of the secondary mixed fluid ejected by the blast gun 40 is enlarged to the configuration of an ejection port 47 at the distal end of the merging chamber 48, while maintaining the abrasive blast pressure and the blast density uniform in the processing pattern at fixed levels.

The abrasive dispersion chamber 52 into which the secondary mixed fluid composed of the abrasive and the secondary compressed air emitted from the blast gun 40 is introduced and which emits it in the form of a blast stream having a desired shape of cross section is connected to the ejection port 47 of the blast gun 40. This enables the processing pattern to be formed to the shape of the cross section of the abrasive dispersion chamber 52.

Figure 4:
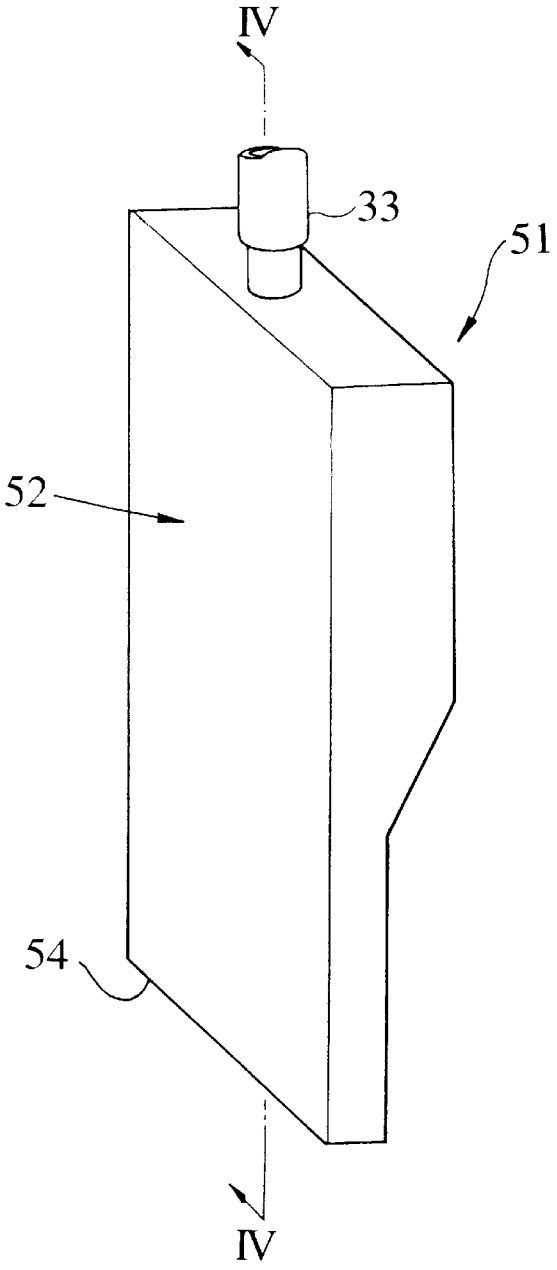
FIG. 4 is a perspective view illustrative of an embodiment of an abrasive dispersion chamber or a dispersion nozzle, according to the present invention.
Figure 5:
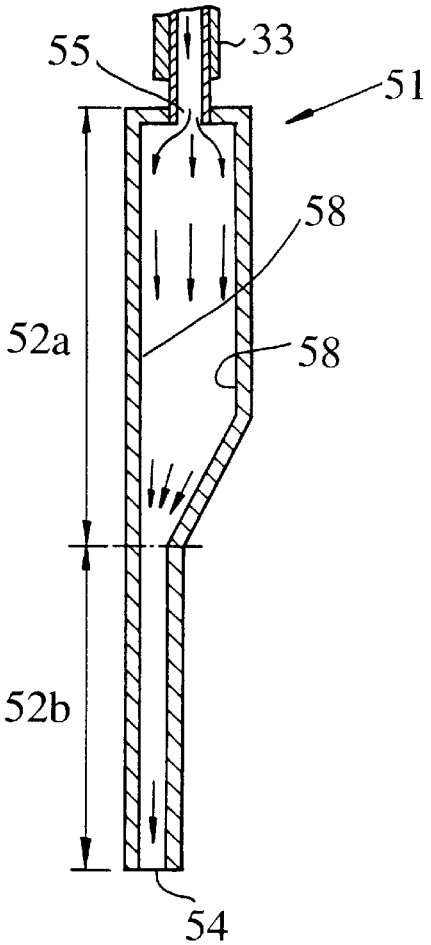
FIG. 5 is a sectional view at the line IV—IV of FIG. 4.

As shown in FIG. 4 and FIG. 5, this abrasive dispersion chamber 52 can be directly connected to the distal end of the blast gun 40; in this embodiment, however, the abrasive dispersion chamber 52 is communicated to the blast gun 40 via a hose 33 which is secured to the inner periphery of the nozzle cover 49 of the blast gun 40 and which is connected to a cylindrical merging nozzle 45 jetting out in the abrasive ejecting direction.

The abrasive dispersion chamber 52 functions to introduce the blast stream of the secondary mixed fluid composed of the abrasive and the secondary compressed air emitted from the blast gun 40 and rectify the blast stream to the shape of the cross section of the abrasive dispersion chamber 52 before ejecting it so as to increase the width of a processing pattern. For this purpose, the abrasive dispersion chamber 52 has an abrasive dispersion space for dispersing and rectifying the secondary mixed fluid composed of the abrasive and the secondary compressed air introduced from the blast gun 40.

The abrasive dispersion space is formed such that it is wider toward a communicating orifice 55 and narrower toward an abrasive ejecting orifice 54. More specifically, the abrasive dispersion chamber 52 according to this embodiment is formed to have a rectangular cross section measuring 30 mm by 100 mm for a length of 100 mm from the communicating orifice 55 toward the abrasive ejecting orifice 54, and the rectangular space continues to an abrasive dispersion section 52*a* which is gradually tapered from the 30-mm width and which continues to an abrasive rectifying section 54*b* measuring 0.7 mm by 100 mm. The abrasive rectifying section 52*b* is formed to have the same rectangular cross section as the abrasive ejecting orifice 54; it is 50 mm long.

In this embodiment, the abrasive ejecting orifice 54 and the abrasive rectifying section 52*b* are formed to have the 0.7-mm short sides as mentioned above; however, the short sides maybe changed within the range of 0.05 mm to 5 mm according to the type of material of a workpiece, processing conditions, required processing accuracy, etc. When using a pulverized abrasive of #240 to #3000 (average particle diameter: 5$\mu$ to 80$\mu$ according to JIS6001), it is preferable that the short sides are 0.1 mm to 3 mm because if they are smaller than 0.1 mmn, then the drag on the inner wall surface of the abrasive rectifying section 52*b* increases, whereas if they are larger than 3 mm, then the problem set forth below would arise when the pulverized abrasive which has been ejected from the abrasive rectifying section 52*b* bumps against a workpiece and reflects.

A part of the abrasive jetted from the center in the depth direction of abrasive rectifying section 52*b* bounces nearly perpendicularly when it hits the workpiece and reflects, and the bounced abrasive bumps against the following ejected abrasive, causing various problems in which the abrasive accumulates on the bottoms of fine grooves to be processed, or the energy of the subsequent abrasive is exhausted, or the abrasive reflects in random directions and the abrasive hits the side wall surfaces of the fine grooves to be processed, scraping the side wall surfaces.

Preferably, the long side of the cross section of the abrasive rectifying section 52*b* is at least ten times as long as the short side. Specifically, when the short side is 0.1 mm to 3 mm, the long side should be 25 mm to 500 mm.

Further, the abrasive rectifying section 52*b* is preferably at least ten times as long as the short side of the cross section to impart straightness to ejected abrasive.

The shape of the abrasive dispersion section 52*a* is not limited to the aforesaid trapezoid in cross section; it may alternatively be an inverse triangular shape, etc. in cross section. Likewise, the shape of the abrasive ejecting orifice 54 is not limited to the long, narrow rectangle; the ejecting orifice 54 may alternately have a long, narrow cross section composed of a combination of an arc part of an ellipse or other curve such as undulation and a straight line or the like.

Forming the abrasive ejecting orifice 54 of the abrasive dispersion chamber 52 to a long, narrow shape makes it possible to increase the width of the processing pattern. For instance, when performing such machining as grinding for forming a plurality of parallel fine grooves to produce the ribs of a plasma display panel (PDP), positioning the long sides of the abrasive jetting orifice 54 orthogonally in relation to the moving direction of the blast gun or a workpiece and setting the moving direction in parallel to the lengths of the recessions or grooves to be formed on the workpiece make it possible to form many grooves or recessed portions at the same time while making the grinding depths of the grooves approximately the same, thus permitting higher machining accuracy.

When the blast gun 40 or 10 is communicated with the communicating orifice 55 of the abrasive dispersion chamber 52 configured as described above via the hose 33 connected to the distal end of the blast gun 40 or the merging chamber 48 in communication with the supply source of compressed air to introduce the blast stream of the second mixed fluid into the abrasive dispersion chamber 52, the blast of the secondary mixed fluid, the pressure of which has been increased from the merging with the secondary compressed air, disperses in the abrasive dispersion section 52*a*. Then, the abrasive in the secondary mixed fluid bumps against both side walls 58, 58 of the long sides of the rectangular cross section of the abrasive dispersion section 52*a* of the abrasive dispersion chamber 52, and changes its direction before it disperses.

Subsequently, the secondary mixed fluid is pushed out to the abrasive rectifying section 52*b* continuing from the abrasive dispersion section 52*a*, and the cross section of the secondary mixed fluid is changed to the long, narrow shape in the abrasive rectifying section 52*b*. The internal pressure of the abrasive dispersion section 52*a* is further increased to promote the dispersion of the secondary mixed fluid, and the secondary mixed fluid introduced into the abrasive rectifying section 52*b* is rectified in the abrasive rectifying section 52*b* and imparted straightness before it is projected through the abrasive ejecting orifice 54.

In this embodiment, the abrasive ejecting orifice 54 corresponding to the long sides is linear in the horizontal direction. The abrasive ejecting orifice 54, however, may be angled to a short side; in this case, the cutting effect or the depth may be changed according to different blasting distances.

Preferably, especially when a pulverized abrasive is used, the distance from the abrasive ejecting orifice 54 of the abrasive rectifying section 52*b* to a workpiece is approximately 200 mm or less which hardly affects the cutting depth. This is because an abrasive would lose its straight advancing property if the injecting distance is excessively long.

Thus, the blast of the secondary mixed fluid ejected from the blast gun 40 can be easily enlarged to the shape of the cross section of the abrasive rectifying section 52*b*. In addition, the blast density of the abrasive in the cross section of the abrasive blast is maintained at a constant level, permitting uniform machining of a workpiece in the processing pattern.

The following shows the results of machining workpieces by using a blasting apparatus which incorporates the blast gun 40 and the abrasive dispersion chamber 52 constructed as described above.

Processing Example 1

[TABLE 1]

| Processing Condition | | | |
|---|---|---|---|
| Blast Gun | | | |
| Jet injection orifice inside diameter (I.D.): 3.2 mm | | | |
| Jet compressed air pressure: 5 kg/cm$^2$ | | | |
| Nozzle injection orifice I.D.: 7.0 mm | | | |
| Secondary compressed air pressure: 1.6 kg/cm$^2$ | | | |
| Abrasive Dispersion Chamber | | | |
| Abrasive dispersion section: | Long side | Short side | Height |
| Straight portion | 100 mm | 30 mm | 100 mm |
| Tapered portion | 100 mm | | 30 mm |
| Abrasive rectifying section: | 100 mm | 0.7 mm | 50 mm |
| Abrasive injection port: | 100 mm | 0.7 mm | |
| Amount of abrasive injected: 250 g/s | | | |
| Distance between workpiece and abrasive injection port: 10 mm | | | |
| Type of abrasive: Carborundum #600 | | | |
| Secondary compressed air pressure: 1.6 kg/cm$^2$ | | | |
| Type of workpiece: Glass pane (Soda glass) | | | |

Under the processing conditions shown above, the nozzle was fixed and the abrasive was injected for one minute. As a result, an orifice almost as large as the abrasive injection port 54 of the dispersion nozzle 51 was cut on the workpiece.

The cut orifice was 380 $\mu$ deep and it had a flat bottom with an approximately uniform rectangular cross section. From this result, it is understood that the blasting apparatus in accordance with the present invention is able to increase the width of the processing pattern to about 31 times the inside diameter of the injection orifice of the jet of the blast gun or about 14 times the inside diameter of the nozzle injection orifice and it is also able to ensure a uniform injection density of the abrasive in the processing pattern.

Hence, the blasting apparatus according to the present invention is suitably applied to the blasting wherein high accuracy is required as in the applications of precision machining and micro-machining.

Processing Example 2

A silicon wafer as a workpiece was machined under the same processing conditions as in Processing Example 1 except that the secondary compressed air pressure was set to 1.0 kg/cm$^2$.

As a result of one-minute injection of the abrasive to the workpiece under the processing conditions mentioned above, an orifice approximately as large as the injection port of the dispersion nozzle 51 was cut on the workpiece.

The orifice was 350 $\mu$ deep and it had an even depth and a flat bottom, proving that the abrasive injection density in the enlarged processing pattern is uniform.

Thus, according to the blasting method and the blasting apparatus in accordance with the present invention, a processing pattern can be easily enlarged or changed in a suction type blasting apparatus, and the injection density of an abrasive in the enlarged or changed processing pattern can be made uniform.

Moreover, according to the blasting method and the blasting apparatus in accordance with the present invention which employ the abrasive dispersion chamber 52 enable a processing pattern to be further enlarged or changed, and the injection density of an abrasive in the enlarged or changed processing pattern can be made even. The processing pattern can be changed to a desired shape.

Furthermore, according to the blasting apparatus of the present invention, a processing pattern can be easily enlarged by replacing the blast gun of a conventional blasting apparatus or by installing the blast gun and the abrasive dispersion chamber in accordance with this invention. This makes it possible to effectively use an existing blasting apparatus, thereby saving cost.

As discussed above, the blast gun employed in this invention is characterized by the structure of the distal end thereof; other components including the body and the jet share the same structures of a conventional known blast gun, thus permitting inexpensive, easy manufacture thereof.

Thus, the broadest claims that follow are not directed to a machine that is configure in a specific way. Instead, said broadest claims are intended to protect the heart or essence of this breakthrough invention. This invention is clearly new and useful. Moreover, it was not obvious to those of ordinary skill in the art at the time it was made, in view of the prior art when considered as a whole.

Moreover, in view of the revolutionary nature of this invention, it is clearly a pioneering invention. As such, the claims that follow are entitled to very broad interpretation as to protect the heart of this invention, as a matter of law.

It will thus be seen that the objects set forth above, and those made apparent from the foregoing description, are efficiently attained. Also, since certain changes may be made in the above construction without departing from the scope of the invention, it is intended that all matters contained in the foregoing description or shown in the accompanying drawings shall be interpreted as illustrative and not in a limiting sense.

It is also to be understood that the following claims are intended to cover all of the generic and specific features of the invention herein described, and all statements of the scope of the invention which, as a matter of language, might be said to fall therebetween.

Now that the invention has been described;

What is claimed is:

1. A blasting method wherein:

an air stream is ejected from a jet in communication with a supply source of compressed air;

an abrasive is drawn in via an abrasive intake chamber, which is formed between said jet and a nozzle disposed at the front in the air injecting direction of said jet, from an abrasive supply source in communication with said abrasive intake chamber;

secondary compressed air supplied from said supply source of compressed air is merged with a primary mixed fluid which is ejected from said nozzle and which is composed of said abrasive and primary compressed air in front of said nozzle in the direction in which said primary mixed fluid is ejected;

a secondary mixed fluid produced by merging said primary mixed fluid and said secondary compressed air is introduced into an abrasive dispersion space;

said abrasive dispersion space being composed of an abrasive dispersion section, the cross section of which in the width direction is gradually narrowed toward the direction in which said secondary mixed fluid is ejected, an abrasive rectifying section formed in front of said abrasive dispersion section and having a rectangular cross section, the cross-sectional shape of said secondary mixed fluid being rectified to the cross-sectional shape of said abrasive dispersion space; and said secondary mixed fluid being injected to the surface of a workpiece.

2. A blasting method according to claim 1, wherein:

the blast stream of said primary mixed fluid is introduced into a merging chamber disposed in front of said nozzle in the direction in which said mixed fluid is ejected; said secondary compressed air supplied from said supply source of compressed air is introduced into said merging chamber;

the blast stream of said primary mixed fluid is merged with said secondary compressed air; and said secondary mixed fluid produced by merging said primary mixed fluid with said secondary compressed air is introduced into abrasive dispersion space at the front in the direction in which said secondary mixed fluid is ejected.

3. A blasting method according to claim 2, wherein the abrasive dispersion section has a long side extending in the direction of the major axis of the cross section the major axis of the cross section of said abrasive dispersion space which is oriented such that it is orthogonal in relation to the moving direction of a blast gun or a workpiece, and said moving direction being parallel to the longitudinal direction of a recessed portion or groove to be formed on said workpiece.

4. A blasting method according to claim 1, wherein said abrasive rectifying space has a cross section composed of a long side or a major axis which is at least ten times longer than a short side or a minor axis and has a height which is at least ten times higher than said short side or said minor axis.

5. A blasting method according to claim 1, wherein said abrasive rectifying section is narrow and long, the short side or the minor axis of the cross section thereof being 0.1 mm to 3 mm, and the long side or the major axis being 25 mm to 500 mm.

6. A blasting method according to claim 1, wherein the cross section of the abrasive dispersion space has a long side or major axis oriented such that the long side or major axis is orthogonal in relation to the moving direction of blast gun or a workpiece, and wherein said moving direction is parallel to the longitudinal direction of a recessed portion or a groove to be formed on said workpiece.

7. A blasting apparatus comprising a suction type blast gun equipped with a nozzle at the front of the air ejecting direction of a jet in communication with a supply source at the front of the air ejecting direction of a jet in communication with a supply source of compressed air and an abrasive intake chamber in communication with an abrasive supply source between said jet and said nozzle; wherein the nozzle of said blast gun is projected into a merging chamber in communication with said supply source of compressed air in front of said nozzle in the ejecting direction and said merging chamber being in communication with an abrasive dispersion chamber;

said abrasive dispersion chamber defining a space composed of an abrasive dispersion section, the cross-section of which in the width direction is gradually narrowed toward the direction in which said secondary mixed fluid is ejected, and an abrasive rectifying section formed in front of said abrasive dispersion section and having a rectangular cross-section, the blast stream of a secondary mixed fluid emitted from said merging chamber being rectified to the cross-sectional shape of said abrasive dispersion chamber and ejected.

8. A blasting apparatus according to claim 6, wherein said abrasive dispersion chamber has a long, narrow rectangular cross section having a long side or major axis which is at least ten times longer than a short side or minor axis, said cross section being maintain for a length which is at least ten times longer than said short side or said minor axis, and the chamber being provided with an abrasive ejection aperture for ejecting an abrasive at a front end thereof.

9. A blasting apparatus according to claim 7, wherein said abrasive dispersion chamber has a narrow, long cross section, the short side or the minor axis thereof being 0.1 mm to 3 mm and the long side or the major axis thereof being 25 mm to 500 mm.

10. A blasting apparatus according to claim 6, wherein said abrasive dispersion chamber comprises an abrasive dispersion section, the cross section of which becomes gradually smaller widthwise in the direction in which said secondary mixed fluid is ejected, and an abrasive rectifying section which is formed in front of said abrasive dispersion section and which has a rectangular cross section.

11. A blasting apparatus according to claim 7, wherein said abrasive dispersion chamber has a long, narrow rectangular cross section having a long side or a major axis of which is at least ten times longer than a short side or minor axis, said cross section being maintain for a length which is at least ten times said short side or said minor axis, and the chamber being provided with an abrasive ejection aperture for ejecting an abrasive at a front end thereof.

12. A blasting apparatus according to claim 7, wherein said abrasive dispersion chamber has a narrow, long cross section, the short side or the minor axis thereof being 0.1 mm to 3 mm and the long side or the major axis thereof being 25 mm to 500 mm.

13. Blasting apparatus according to claim 7, wherein said blast gun has a compressed air passage in communication with said supply source of compressed air between the outer surface of said nozzle and the inner surface of a component such as a nozzle cover or a gun body which surrounds said nozzle with a predetermined gap therebetween so as to permit purging with the blast stream of said mixed fluid in front of said nozzle in the direction in which said mixed fluid is ejected.

* * * * *